US007648612B2

(12) United States Patent
Kanitz et al.

(10) Patent No.: US 7,648,612 B2
(45) Date of Patent: Jan. 19, 2010

(54) PAPERMAKING MACHINE FOR FORMING TISSUE EMPLOYING AN AIR PRESS

(75) Inventors: Roger A. Kanitz, Menasha, WI (US); Thomas D. Rogers, Roscoe, IL (US)

(73) Assignees: Metso Paper, Inc., Helsinki (FI); Mitsubishi Heavy Industries, Ltd., Tokyo (JP)

( * ) Notice: Subject to any disclaimer, the term of this patent is extended or adjusted under 35 U.S.C. 154(b) by 253 days.

(21) Appl. No.: 11/758,558

(22) Filed: Jun. 5, 2007

(65) Prior Publication Data

US 2007/0267157 A1 Nov. 22, 2007

Related U.S. Application Data

(60) Continuation of application No. 11/073,968, filed on Mar. 7, 2005, now Pat. No. 7,241,364, which is a continuation of application No. 10/448,840, filed on May 30, 2003, now Pat. No. 6,863,777, which is a continuation of application No. 10/261,186, filed on Sep. 30, 2002, now Pat. No. 6,613,194, which is a continuation of application No. 09/825,088, filed on Apr. 3, 2001, now Pat. No. 6,458,246, which is a division of application No. 09/324,469, filed on Jun. 2, 1999, now Pat. No. 6,231,723.

(51) Int. Cl.
*D21H 11/00* (2006.01)

(52) U.S. Cl. ..... 162/111; 162/116; 162/260; 162/280; 162/109

(58) Field of Classification Search ..... 162/111, 162/260, 280, 116, 109, 206, 290, 358.1, 162/358.2, 358.3
See application file for complete search history.

(56) References Cited

U.S. PATENT DOCUMENTS 3,224,928 A 12/1965 Lee et al.

(Continued)

FOREIGN PATENT DOCUMENTS

DE 42 42 730 C1 9/1993

(Continued)

OTHER PUBLICATIONS

Jeffrey Lindsey, Displacement dewatering to maintain bulk, Paper and Timber, vol. 74/No. 3/1992, pp. 232-233.

(Continued)

*Primary Examiner*—Mark Halpern
(74) *Attorney, Agent, or Firm*—Alston & Bird LLP

(57) ABSTRACT

A web of tissue is formed in a twin wire former, followed by an air press for water removal in the pressing section, passing onto a Yankee dryer. A headbox injects stock between upper and lower dryer fabrics brought together on a breast roll. The fabrics moves over vacuum boxes, and the web is heated with steam and passed between an upper pressure box and a lower vacuum box forming an air press which dewaters the web. A sheet transfer pickup vacuum box holds the sheet to the upper fabric as the lower fabric diverges from the upper fabric. A pressure roller transfers the web onto a Yankee dryer. The fabrics are cleaned on vertical runs before returning to the breast roll. A final forming fabric is arranged to operated at a lower speed than the penultimate forming fabric so that a rush transfer and creping like action takes place.

4 Claims, 7 Drawing Sheets

U.S. PATENT DOCUMENTS

| | | | |
|---|---|---|---|
| 3,470,063 | A | 9/1969 | Sanford |
| 4,124,441 | A | 11/1978 | Nykopp |
| 4,144,124 | A | 3/1979 | Turunen et al. |
| 4,888,096 | A | 12/1989 | Cowan et al. |
| 5,225,042 | A | 7/1993 | Eaton et al. |
| 5,230,776 | A | 7/1993 | Andersson et al. |
| 5,238,534 | A | 8/1993 | Manning et al. |
| 5,274,930 | A | 1/1994 | Ensign et al. |
| 5,393,384 | A | 2/1995 | Steiner et al. |
| 5,500,092 | A | 3/1996 | Schiel |
| 5,625,961 | A | 5/1997 | Ensign et al. |
| 5,670,023 | A | 9/1997 | Steiner et al. |
| 6,080,279 | A | 6/2000 | Hada et al. |
| 6,083,346 | A | 7/2000 | Hermans et al. |
| 6,090,241 | A | 7/2000 | Trokhan et al. |
| 6,093,284 | A | 7/2000 | Hada et al. |
| 6,096,169 | A | 8/2000 | Hermans et al. |
| 6,103,063 | A | 8/2000 | Oriaran et al. |
| 6,143,135 | A | 11/2000 | Hada et al. |
| 6,149,767 | A | 11/2000 | Hermans et al. |
| 6,187,137 | B1 | 2/2001 | Druecke et al. |
| 6,306,257 | B1 | 10/2001 | Hada et al. |
| 6,306,258 | B1 | 10/2001 | Lange et al. |
| 2003/0136018 | A1 | 7/2003 | Herman et al. |

FOREIGN PATENT DOCUMENTS

| | | | |
|---|---|---|---|
| WO | 99/23298 | A1 | 5/1999 |

OTHER PUBLICATIONS

Search Report for PCT/US00/14900 dated Oct. 31, 2000.

PAPERMAKING MACHINE FOR FORMING TISSUE EMPLOYING AN AIR PRESS

CROSS REFERENCES TO RELATED APPLICATIONS

This application is a continuation of U.S. application Ser. No. 11/073,968, filed Mar. 7, 2005, now U.S. Pat. No. 7,241,364 which is a continuation of U.S. application Ser. No. 10/448,840, filed May 30, 2003, now U.S. Pat. No. 6,863,777; which is a continuation of U.S. application Ser. No. 10/261,186 filed Sep. 30, 2002, now U.S. Pat. No. 6,613,194; which is a continuation of U.S. application Ser. No. 09/825,088 filed Apr. 3, 2001, now U.S. Pat. No. 6,458,246, which is a divisional of U.S. application Ser. No. 09/324,469, filed Jun. 2, 1999, now U.S. Pat. No. 6,231,723, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to papermaking machines used in forming tissue grades of paper in general and to machines employing crescent formers and twin wire formers in particular.

Tissue is a lightweight grade of paper which is formed, pressed and dried on a single large dryer called a Yankee dryer. The tissue is creped from the surface of the Yankee dryer by a doctor blade creating a soft absorbent tissue. Tissue is widely used in products such as toilet paper, paper towel, napkins, and facial tissues.

A typical tissue forming machine consists of a fourdrinier former which transfers the web to a press felt which conducts the tissue web through a pressing section. Following the pressing section the web is pressed against a Yankee dryer roll to firmly adhere the web to the surface of the roll. The transfer roll may have a nip loading of approximately 200 pounds per linear inch and sometimes various sprays are used to increase adherence to the surface of the Yankee dryer roll. The tissue web is rapidly dried on the surface of the Yankee dryer which may have a diameter of over 22 feet. The dried web is scraped off the surface of the dryer by a doctor blade in a process known as creping which increases the bulk and absorbency of the tissue.

When attempting to modernize a typical older tissue making machine, the forming section, which has limited water handling capacity, which impacts formation potential, and needs substantial upkeep due to age, is advantageously replaced with a modern twin wire former or crescent former. Updating the pressing section, however, presents problems: modern fabrics are stiff and cannot be bunched up and threaded through the threading openings on older machines.

The existing pressing section typically cannot sufficiently reduce the water content of the higher speed web produced by the new crescent or twin-wire former. Because drying capability is limited by the maximum size and temperature of the Yankee dryer, if the performance of older machines is to be increased without increased drying capability, a solution which improves the capacity of the pressing section must be found. At the same time, it is necessary to eliminate the long spans where the web is supported by a felt, which have the potential for sheet drop-offs and hole formation.

What is needed is a combination of tissue forming section and press section which can be used to improve the performance of existing tissue making machines.

SUMMARY OF THE INVENTION

The papermaking machine of this invention forms a web of tissue in a crescent former, followed by an air press for water removal in the pressing section. The web is then pressed onto a Yankee dryer for drying. The crescent former employs a breast roll around which a upper fabric and a lower fabric are brought together. A headbox injects a stream of stock between the two fabrics as they are brought together on the breast roll. The upper fabric engages the breast roll first, and water is driven off through the lower fabric due to centrifugal acceleration as the wires move together around the breast roll. The two forming fabrics move together over a series of vacuum boxes, and the sheet is heated with steam and passed between an upper pressure box and a lower vacuum box forming an air press which dewaters the web by forcing air through the web. A sheet transfer pickup vacuum box holds the sheet to the upper fabric as the lower fabric diverges away from the upper fabric. A pressure roller transfers the web onto the surface of a Yankee dryer. A tail cutter is located between the sheet transfer box and the pressure roller. Each of the fabrics has a vertical run of fabric before it returns to the breast roll. The vertical runs allow the forming fabrics to be cleaned while baffles prevent the cleaned fabric from being sprayed.

Various modifications can be made to the basic design. A second upper fabric or transfer fabric operating at a lower speed then the first upper fabric can be used to form a rush transfer between the forming fabrics and the Yankee dryer which increases web bulk and absorbency. Instead of a second fabric, a vacuum pressure roll may perform the rush transfer between the lower forming fabric and the Yankee dryer.

The lower fabric may be divided into two fabrics, and the second fabric which passes through the air press, can be used to mold a texture into the web.

The rush transfer and the molding fabric may be combined in one machine.

A twin wire former may be used instead of a crescent former in each of the above configurations.

It is a feature of the present invention to provide a replacement forming and pressing section to an existing papermaking machine for forming tissue.

It is another feature of the present invention to provide a pressing section of shorter length.

It is a further feature of the present invention to provide for cleaning forming fabrics as they move upwardly along a vertical path.

It is a further feature of the present invention to increase the speed at which a tissue forming papermaking machine operates.

It is yet another feature of the present invention to provide means for integrating an air press into a papermaking machine for forming tissue grades of paper.

A yet further feature of the present invention is to provide an improved tissue former which utilizes portions of an existing machine and thus reduces costs.

Further objects, features and advantages of the invention will be apparent from the following detailed description when taken in conjunction with the accompanying drawings.

DESCRIPTION OF THE PREFERRED EMBODIMENTS

Figure 1:
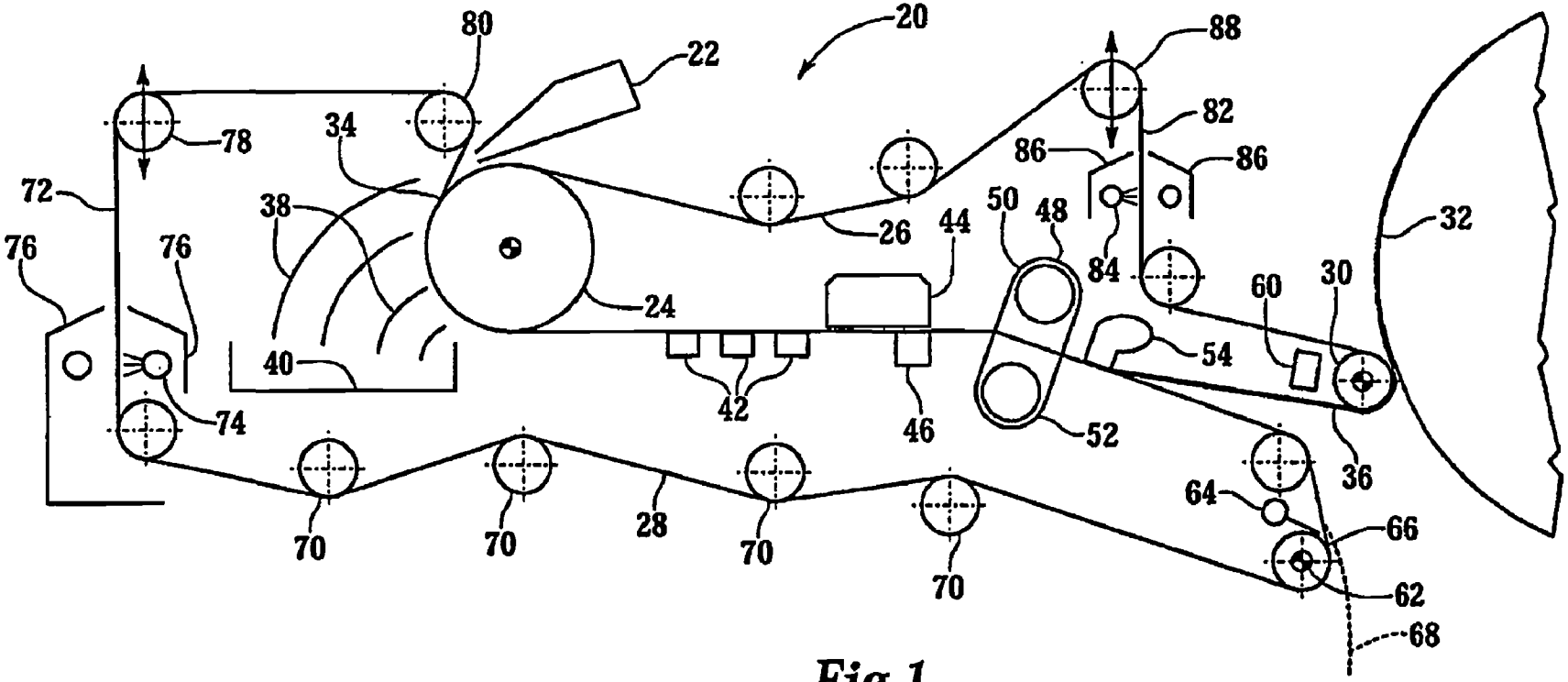
FIG. 1 is a schematic view of a crescent former and pressing section employing an air press for forming and pressing a tissue web.

Referring more particularly to FIGS. 1-8 wherein like numbers refer to similar parts, a papermaking machine 20 for forming tissue grades of paper is shown in FIG. 1. The apparatus 20 has a headbox 22 which is positioned over a breast roll 24 to inject a stream of stock into a nip 34 formed between an upper forming fabric 26 and a lower forming fabric 28. The upper forming fabric 26 forms an endless loop which contains the breast roll 24 and a pressure roll 30 which presses the upper forming fabric 26 against a Yankee dryer 32. The nip 34 is formed where the lower forming fabric 28 is wrapped onto the upper forming fabric 26 as it wraps around the breast roll 24. A tissue web 36 is formed as water is removed from the stock by suction into the breast roll 24 and by the action of centrifugal force which causes water to be thrown outwardly where curved baffles 38 direct it into a saveall 40.

The upper fabric 26 and lower fabric 28 with the web 36 sandwiched therebetween passes over a series of vacuum boxes 42 which further dewater the web 36. The web is then heated by a steam shower 44 positioned over a vacuum box 46. Heating the web reduces the viscosity of the water contained in the web. The web 36 sandwiched between the upper fabric 26 and the lower fabric 28 then passes through an air press 48 consisting of an upper pressure box 50 and a lower vacuum box 52. The air press 48, which is described more fully in U.S. application Ser. No. 08/962,110, filed Oct. 31, 1997, entitled Air Pressing Equipment and Processes, which is incorporated herein by reference. U.S. Pat. No. 5,225,042 Eaton et al. which is incorporated herein by reference, describes a apparatus for dewatering a web formed by a twin wire former. Eaton et al. describes pressure dome on one side of a sandwich of two forming fabrics and a web held therebetween and a opposed curved vacuum box which receives water from the web. Eaton et al. uses the terminology pressure dome and water collecting chamber to refer to the disclosed air press. Such terminology is analogous to the terminology used herein of a pressure box opposed to a vacuum box.

The air press 48 is positioned about the upper forming fabric 26 and the lower forming fabric 28 and the web 36 is positioned therebetween. Air is supplied to the pressure box 50 and flows through the relatively permeable upper forming fabric 26, through the web 36, and finally through the relatively permeable lower forming fabric 28.

The large area of the pressure box 50, which may be six inches wide in the machine direction, as compared to a jet of air, means that air flows with relatively low velocity through the web and applies a relatively high pressure of about fifteen to thirty psi to the web 36 as it passes between the pressure box 50 and the vacuum box 52. Pressure in the vacuum box 52 is typically about fifteen inches of Mercury below atmospheric or about seven psi vacuum. Thus the total pressure drop across the web 36 is approximately twenty to thirty-five psi and almost all the pressure drop occurs through the web 36 thickness. The web 36 is relatively thin, approximately a few hundredths of an inch or less, as air moves through the web it sees the twenty to thirty-five psi pressure drop, by dividing pressure drop by the thickness of the web, a value for the pressure gradient across the web can be calculated, demonstrating the large pressure gradient through the web.

The effect of the rapid expansion of air as it passes through the web 36 is to remove water from the web. As described in U.S. application Ser. No. 08/962,110, an air press device used on a tissue web having a solids content of about twenty-five percent and a thickness of about three hundredths of an inch was able to increase the solids content to approximately thirty-three percent. Although the precise mechanism is not clearly understood, the use of pressurized air is more effective than vacuum alone because of the higher pressures available and the greater air volume forced through the web. The upper fabric 26 and the lower fabric 28 are substantially more permeable then the web so that almost all the pressure drop occurs across the web 36.

The mechanism of the air press 48 is distinct from a system using jets of air directed at a web. A jet of air is difficult to maintain with uniformly along the machine direction. Further the magnitude of the dynamic pressure differential which can be developed is generally lower than the static air press pressure developed in the enclosed air press frame 50.

Following the air press 48, the lower fabric 28 is directed away from the upper fabric 26 and a sheet transfer pickup box 54 draws a vacuum on the upper fabric 26 to cause the web 36 to follow the upper forming fabric 26. The web 36 then travels around a pressure roller 30 which presses against the Yankee dryer 32 with a pressure of approximately two hundred pounds per linear inch and transfers the web 36 to the surface of the Yankee dryer 32. A tail cutter 60 may be located above the upper fabric 26 between the pickup box 54 and the pressure roller 30. And similarly, sheet trim apparatus (not shown) may be located between the pickup box 54 and the pressure roller 30.

The lower fabric 28 continues down around a drive roll 62. A spray 64 creates a flooded nip 66 between the upper side of the drive roll 62 and the lower fabric 28. The flooded nip causes the web 68 if it has not been transferred by the pickup box 54 to become saturated and leave the lower fabric 28 under the influences of gravity. The lower forming fabric 28 returns to the forming section of the papermaking machine 20 through a series of idler rolls 70. The lower fabric 28 enters a vertical run 72 where water showers 74 contained within baffles 76 clean the fabric 28 before it returns to the breast roll 24. A stretcher roll 78 allows the tension in the lower fabric 28 to be adjusted and a guide roll 80 guides the fabric 28 into engagement with the breast roll 24.

After leaving the press roll 30, the upper fabric 26 moves through a vertical run 82 where it is washed by water showers 84 within baffles 86. The upper fabric 26 passes over an adjustable stretcher roll 88 and returns to wrap around the breast roll 24.

Figure 2:
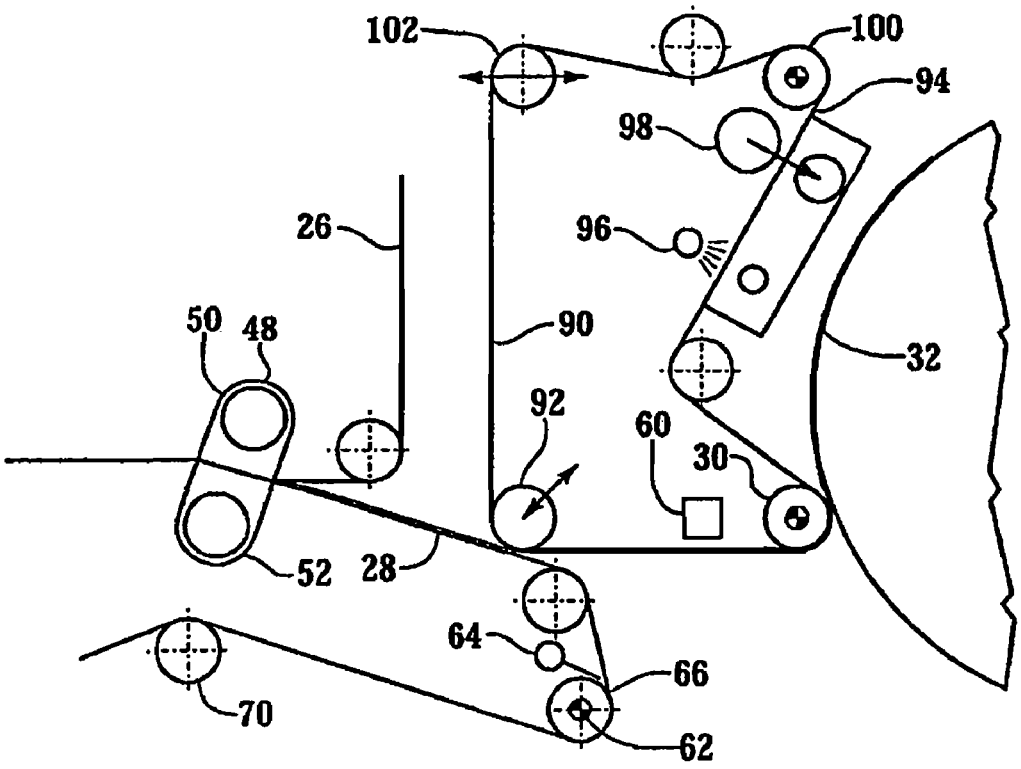
FIG. 2 is a fragmentary schematic review of an alternative transfer apparatus for creating a rush transfer between the pressing section and the Yankee dryer of FIG. 1 or FIG. 5

FIG. 2 shows an addition of a second upper fabric 90 between the air press 48 and the press roll 30. The addition of the second fabric 90 involves the elimination of the web transfer pickup box 54 shown in FIG. 1, and the addition of a suction pickup roll 92 which takes the web 36 from the lower fabric 28. The pickup roll 92 is adjustable and the second upper fabric 90 is operated at a lower speed than the lower fabric 28 so that a rush transfer is created wherein a creping like action takes place as the web transfers from the lower fabric 28 to the slower speed fabric 90. The second upper fabric 90, after wrapping around the press roll 30, enters an inclined cleaning run 94 where a water shower 96 is followed by an air knife 98. The second upper fabric 90 then turns around a helper drive roll 100 to a stretcher roll 102 and returns to the suction pickup roll 92. The use of a rush transfer increases the bulk and absorbency of the web 36 without additional fiber.

Figure 6:
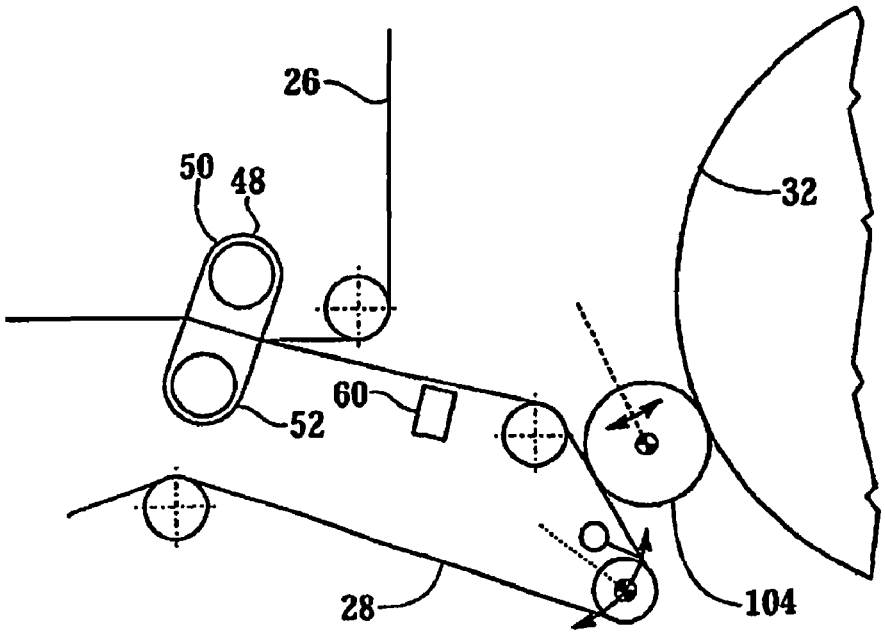
FIG. 6 is a further fragmentary schematic view of an apparatus for creating a rush transfer of a tissue web from the pressing section of FIG. 1 or FIG. 5

Rush transfer can also be accomplished with a vacuum pressure roll 104 as shown in FIG. 6. The vacuum pressure roll 104 is positioned between the Yankee dryer 32 and the lower fabric 28. The tail cutter 60 is positioned below the lower fabric 28 as shown in FIG. 6. A trim means (not shown) can also be positioned above the lower fabric 28.

Figure 3:
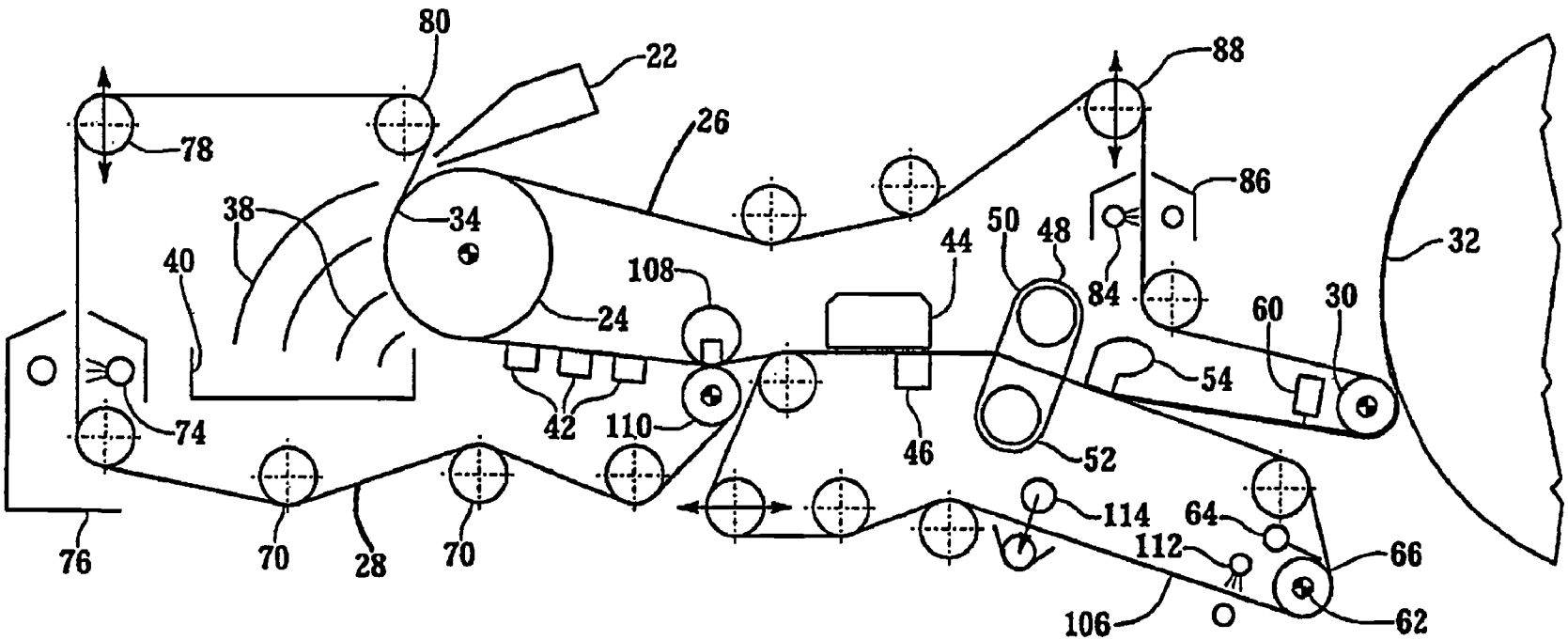
FIG. 3 is a schematic view of an alternative embodiment of the forming and pressing section of FIG. 1 wherein a second lower felt allows molding the formed web.

A second lower fabric 106 can be employed with the papermaking machine 20 of FIG. 1. As shown in FIG. 3, a vacuum pickup roll 108 is added to the upper fabric 26 just in front of the steam shower 44 to pick the web off the lower forming fabric 28. A drive roll 110 is added inside the loop formed by the lower fabric 28. The second lower fabric 106 incorporates a shower 112 and an air knife 114 downstream of the flooded nip 66 to clean the second lower fabric 106. By dividing the lower fabric into two parts the ability to mold the web 36 into a specialized fabric is created. Thus the second lower fabric 106 may have a texture which imparts specialized functionality or appearance to the web 36.

Figure 4:
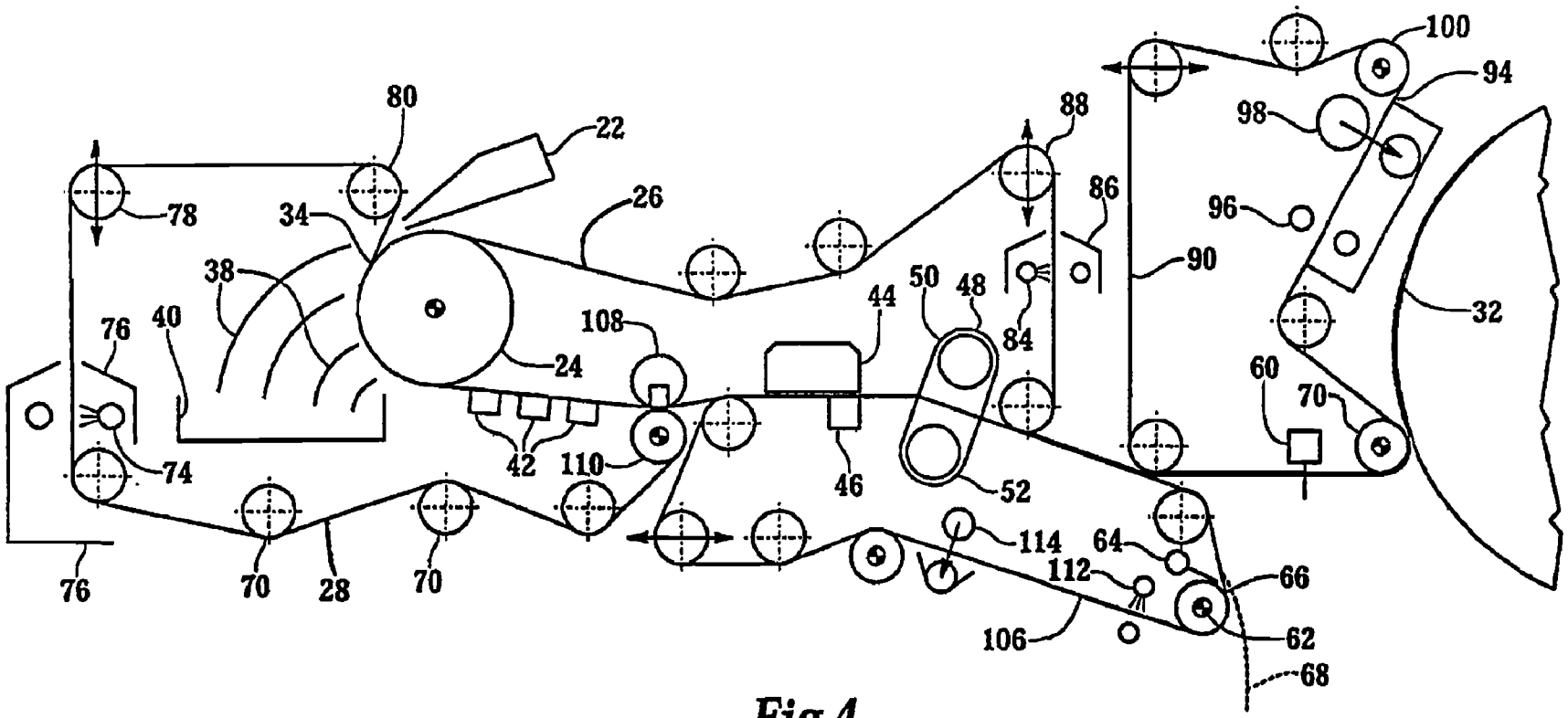
FIG. 4 is a schematic view of a yet further embodiment of the forming and pressing section of FIG. 1 combining the features of the apparatus of FIG. 2 and FIG. 3.

The ability to create a rush transfer as described with respect to FIG. 2 in combination with molding the web 36 with a second lower fabric 106 is shown in FIG. 4.

Figure 5:
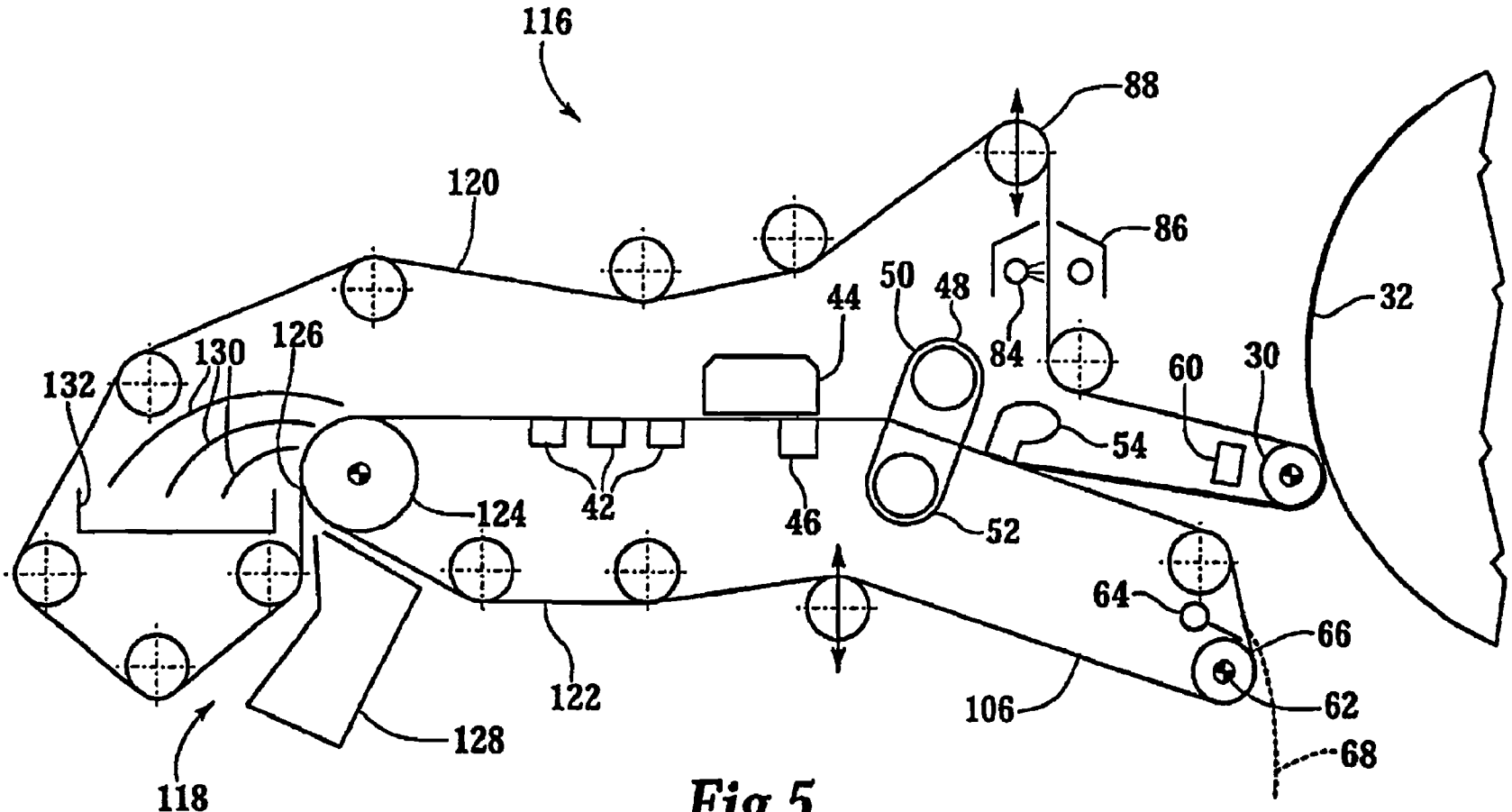
FIG. 5 is a still further alternative embodiment of the forming and pressing sections of FIG. 1 wherein a twin wire former is employed.

An alternative embodiment papermaking machine 116 for forming tissue grades of paper is shown in FIG. 5. The papermaking machine 116 employs a twin wire former 118 formed by an upper forming fabric 120 and a lower forming fabric 122 which wrap around a breast roll 124. The breast roll 124 is inside the loop formed by the lower fabric 22. The upper fabric 120 comes together with the lower fabric 122 to form a nip 126. A headbox 128 injects a stream of stock into the nip 126. Centrifugal force causes water to be thrown outwardly and be captured by baffles 130 which direct water to a saveall 132. In all other respects, the papermaking machine 116 is similar to the machine 20 shown in FIG. 1.

Various modifications to the basic machine 116 can be made by incorporating a second upper fabric 90 as shown in FIG. 2, or a vacuum pressure roll 104 as shown in FIG. 6.

Figure 7:
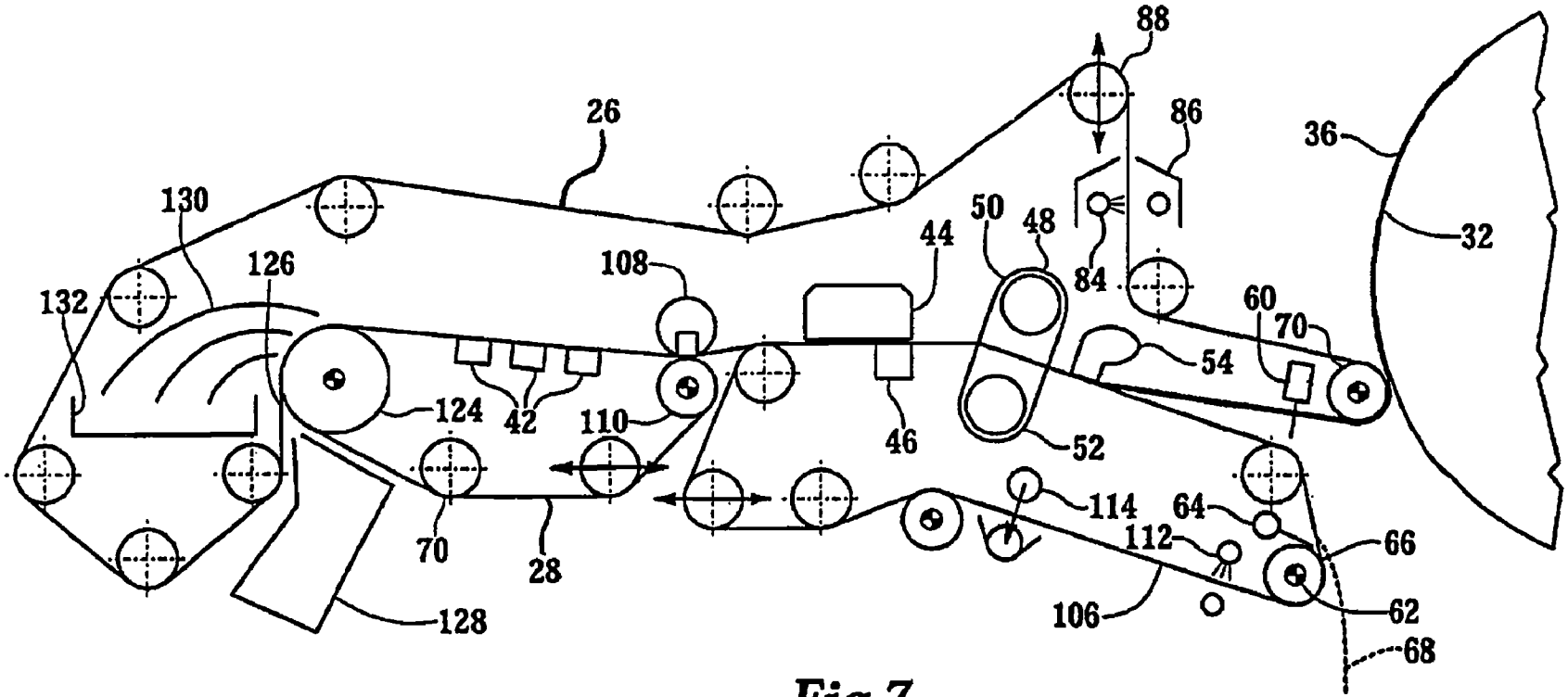
FIG. 7 is a schematic view of another alternative embodiment combining the features of FIG. 5 with the second lower felt used for molding of FIG. 3.

FIG. 7 is similar to FIG. 3 and shows the addition of a second lower fabric 106 which provides the ability to mold a pattern into the web 36. The features of FIG. 2 can be incorporated with the configuration of FIG. 7 to produce the configuration of FIG. 8 which is similar to the crescent former of FIG. 4.

It should be understood that the breast roll used in the crescent former or the twin wire former may be a vacuum roll or may be a plain roll depending on various factors including the speed and thickness of the web being formed.

It should be understood that wherein a rush transfer is described, a drag transfer where the web is stretched is also possible.

Figure 8:
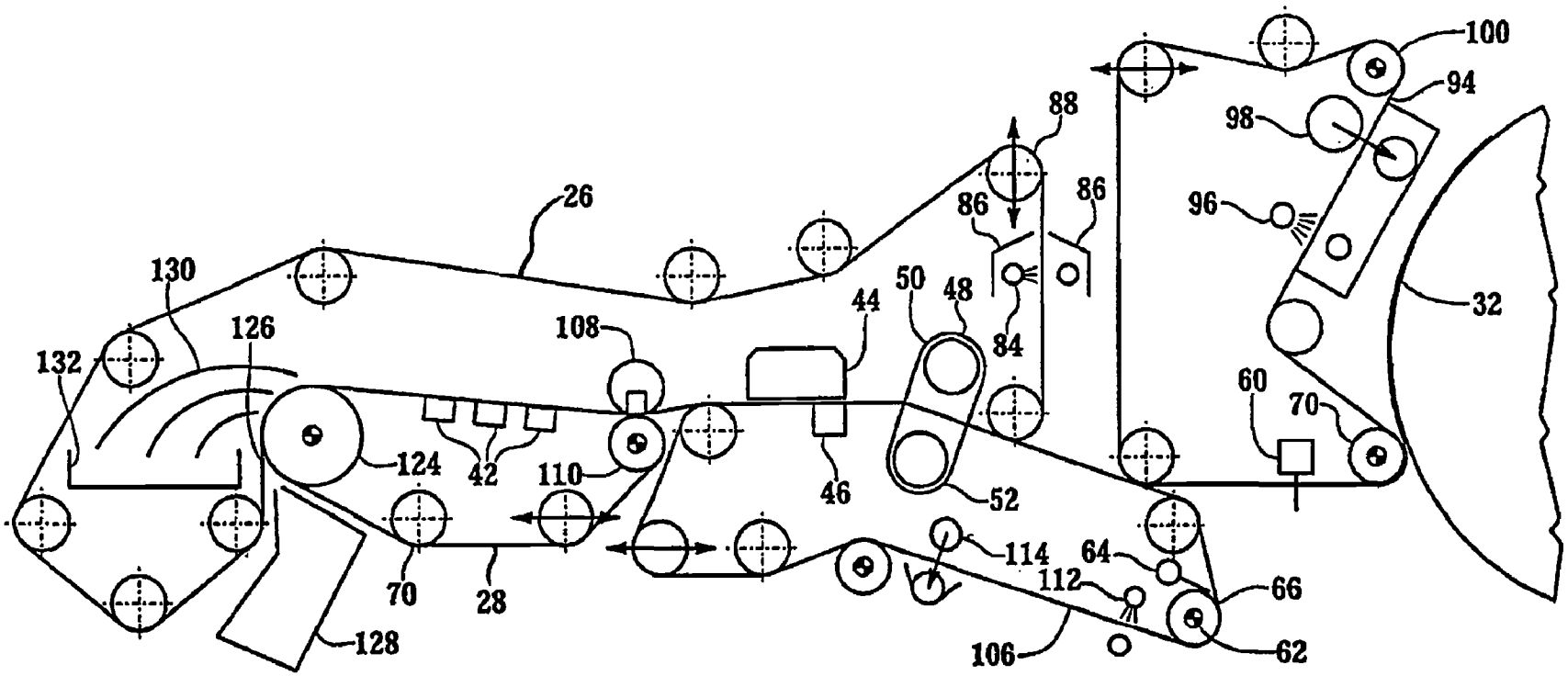
FIG. 8 is a schematic view of another alternative embodiment apparatus combining the features of FIG. 6 and FIG. 7.

It should be understood that the suction pickup roll 92 shown in FIG. 2 and generally as shown in FIGS. 4 and 8 could be a suction shoe which does not rotate.

In interpreting the drawing rolls shown with opposed dark sectors near the center are drive rolls or assistant drive rolls. Rolls with an arrow passing through them are mounted to move to adjust tension in a forming fabric. Rolls which show a pivot line as in FIG. 6 symbolize the mounting of the roll to pivot as indicated by the arrows.

Certain grades of paper, such as tissue paper or creped papers, are typically formed by pressing the web onto a large diameter Yankee dryer, and creating a soft absorbent web by scraping the web off the dryer surface with a doctor blade. Alternative approaches hold out the possibility of increasing absorbency and increased forming speed while living within the limitations of an existing single large diameter Yankee dryer. Rush transfer is an alternative means of increasing absorbency in the formation of a tissue web. New approaches may lead to more cost-effective approaches to manufacturing these important and widely used grades of paper.

In accordance with one embodiment of the present invention, a paper machine for manufacturing a creped tissue web comprises a first forming fabric forming an endless loop; a second forming fabric forming an endless loop, the second forming fabric coming into engagement with the first forming fabric and forming a twin wire former; a headbox positioned to inject a stream of paper stock between the first forming fabric and the second forming fabric; a Yankee dryer for drying the tissue web, the first fabric being adapted to carry the web to the Yankee dryer; a third fabric, the third fabric arranged to run together with the first forming fabric and adapted to enclose the tissue web therebetween; and a dewatering device adapted to dewater the tissue web situated between the third fabric and the first forming fabric, said dewatering device comprising a device for applying a vacuum for creating an air flow through the third fabric, the first forming fabric, and the tissue web therebetween, one of said first forming fabric and third fabric having a texture, which when the fabrics run over the vacuum device said texture is being imparted to the tissue web.

The dewatering device in one embodiment comprises the vacuum device having a curved surface interacting with the first forming fabric and the third fabric. Alternatively, the dewatering device comprises an air press having a pressurized device and a vacuum device. The dewatering device can further comprise a steam device positioned over the vacuum device for heating the web sandwiched between the third fabric and the first forming fabric.

In some embodiments, the first forming fabric extends to the Yankee dryer. A roll can be arranged to transfer the tissue web having the imparted texture to the Yankee dryer while being supported by the first forming fabric.

The dewatering device in some embodiments can be adapted to increase a solids content of the web to approximately 33%. The pressurized device can be adapted to apply a pressure of about 15 to 30 psi to the web. The vacuum device can be adapted to create the air flow through the first fabric and the third fabric and the tissue web sandwiched therebetween and adapted to apply about fifteen inches of mercury below atmospheric or about 7 psi vacuum. The air press comprising the dewatering device can be adapted to create a pressure drop across and through the thickness of the web of about 20-35 psi.

It is understood that the invention is not limited to the particular construction and arrangement of parts herein illustrated and described, but embraces such modified forms thereof as come within the scope of the following claims.

We claim:

1. A method of manufacturing a creped tissue web comprising the steps of:

forming a tissue web between a first permeable forming fabric and a second permeable forming fabric of a twin wire former;

partially dewatering the tissue web, while the tissue web is guided between the first permeable forming fabric and a third fabric, the first permeable forming fabric, tissue web, and third fabric forming a sandwich structure, the partial dewatering of the tissue web being performed by passing the sandwich structure between an air-supplying device and an opposed vacuum device having a curved surface along which the sandwich structure passes, the air-supplying device causing a flow of air from the air-supplying device through the first permeable forming fabric, through the tissue web, and through the third fabric into the vacuum device; and finally drying the tissue web on a Yankee dryer.

2. The method of claim 1, further comprising a step of:

heating the tissue web with steam from a steam device while sandwiched between the first permeable forming fabric and the third fabric.

3. The method of claim 2 further comprising the steps of:

carrying the partially dewatered tissue web on the first permeable forming fabric to the Yankee dryer, transferring the tissue web directly from the first permeable forming fabric onto the Yankee dryer; and after finally drying the tissue web on the Yankee dryer, creping the tissue web from the Yankee dryer.

4. The method of claim 1, further comprising a step of:

imparting a fabric texture into the tissue web while the tissue web is sandwiched between the first permeable forming fabric and the third fabric.

* * * * *